US005520386A

United States Patent [19]

Sasko

[11] Patent Number: 5,520,386

[45] Date of Patent: May 28, 1996

[54] HOCKEY STICK TRAINING WEIGHT

[76] Inventor: Jeffry P. Sasko, 137 Whisperwood Dr., Lexington, S.C. 29072

[21] Appl. No.: 304,580

[22] Filed: Sep. 12, 1994

[51] Int. Cl.[6] ..... A63B 69/00; A63B 59/14

[52] U.S. Cl. ..... 273/57.2; 273/67 A

[58] Field of Search ..... 273/67 A, 72 R, 273/72 A, 26 B, 80, 57.2, 73

[56] References Cited

U.S. PATENT DOCUMENTS

| | | | |
|---|---|---|---|
| 2,912,245 | 11/1959 | Gardner | 273/67 A |
| 3,834,697 | 9/1974 | McNamara, Jr. et al. | 273/67 A |
| 4,364,560 | 12/1982 | Gemmel | 273/67 A |
| 4,452,451 | 6/1984 | Dubreuil | 273/67 A |
| 5,120,055 | 6/1992 | McCarthy et al. | 273/67 A |
| 5,127,649 | 7/1992 | Carbonero | 273/67 A |

FOREIGN PATENT DOCUMENTS

| | | | |
|---|---|---|---|
| 936553 | 11/1973 | Canada | 273/67 A |

*Primary Examiner*—Mark S. Graham
*Attorney, Agent, or Firm*—Michael A. Mann

[57] ABSTRACT

An inverted U-shaped hockey stick weight training device comprises a bridge member integrally joined to two depending plates. The two plates frictionally engage the faces of the blade, conform to its curve and provide a uniform weight distribution throughout the entire length of the blade. A hole is formed in the bridge member with a tether running therethrough, securing the training device to the shaft of the hockey stick. The training device is made of a flexible, resilient plastic and can be manufactured in a variety of weights.

17 Claims, 2 Drawing Sheets

HOCKEY STICK TRAINING WEIGHT

BACKGROUND OF THE INVENTION

1. Field of the Invention

The present invention relates to weights used with sports equipment for training. In particular, the present invention is a weight that is used on a hockey stick for muscle training.

2. Discussion of Background

Training weights used with sports equipment are known in a number of different sports. The ring-shaped weights used with baseball bats are a familiar example. Weights train the muscles used in the particular motion of the body for that sport; those muscles then become conditioned to respond in the same way when called upon. This type of training or conditioning is called "muscle memory."

There are a great many muscles in the abdomen, the chest, the arms, the neck, the shoulders, and the back of the human body, and each sport uses these muscles in different ways and to different degrees. The swing of a baseball bat is much different than the two-handed swing of a tennis racket; the swing of a golf club is much different than the swing of a hockey stick.

In the sport of hockey, a player, through the use of a hockey stick, must learn to handle a puck smoothly and effectively and to shoot with accuracy and strength. Normally, the stick used in hockey is comprised of a shaft with a handle on one end and a blade extending from the other end. In use, the player grasps the stick with one hand on the handle and the other on the shaft. A good hockey player must develop a muscle "memory." That is, the player learns how to use his muscles so that the swing of the stick produces the desired trajectory and speed, regardless of the position of the puck with respect to the blade, the force imparted on the puck and the motion of the player's wrist when imparting such force.

In order for a training weight to aid in the development of a player's skills, the device must impart sufficient weight necessary for conditioning, but not distort the "memory" required for accuracy. Prior to the present invention, stick weights have suffered various problems which have decreased their efficiency and increased the dangers associated with their use. The following is a brief review of prior art stick weights and the problems encountered with their use.

It is known to attach weight along the shaft of the stick. Gemmel (U.S. Pat. No. 4,364,560) discloses a U-shaped weight that can be attached to the shaft or handle of the stick and secured by clamp screws. A cover wraps around the exposed screws, protecting the player from injury. Similarly, Canadian Patent No. 936,553 discloses a weighted disk which is placed on the shaft of the stick and secured by a wing or thumbscrew. The weight imparted on the stick by such designs is concentrated over a limited area of the shaft. Consequently, when a player handles or shoots the puck, such a player must "compensate" for the concentrated load. Thus, during practice, the player develops a shooting "memory" based on weight concentrated at the base of the shaft rather than at the blade. Thereafter, when the weight is removed, the player's "memory" causes inaccurate passes and shots because the weight of the puck is concentrated on the blade and not on the shaft. The result is that a player using a conventional shaft weight will develop the wrong "memory."

Another problem associated with prior stick weights is that they are often fastened by screws. Screws penetrate the surface of the stick. When removed, such penetrations become potential stress fracture points, thereby making the stick more susceptible to fractures and cracks. This, in turn, decreases the useful life of the stick and increases the danger of player injury. Moreover, poor securement of the screws produces a training weight that "rattles" against the blade and/or moves out of place. This condition results in player distraction, difficulty in handling and poor shooting. Frequently, aggressive shooting causes these weights to loosen. As a result, the weight becomes a projectile and can cause damage and serious player injury.

Therefore, there remains a need for an effective and safe training weight for a hockey stick.

SUMMARY OF THE INVENTION

According to its major aspects and briefly stated, the present invention is a training weight for a hockey stick comprising an inverted "U"-shaped weight that straddles and grips the blade of the stick, and a tether running through a hole in the weight and around the base of the stick's shaft. The weight, preferably made of plastic, extends the full length of the blade and conforms to its curve.

The shape of the weight is an important feature of the present invention. The plates that form the inverted "U"-shape converge so that, when placed on the blade of the hockey stick, the plates "pinch" the blade to hold the weight in place by friction, thus avoiding screws and other attachment devices, simplifying installation on the blade, and providing effective holding power.

The use of a tether as an additional way to secure the weight to the base of the handle, another feature of the invention, complements the holding power of the weight's shape. Furthermore, during play, the weight would be most likely to come off while taking a shot, the weight being slung off the end of the blade. The location of the: tether enables it to act counter to that direction, thereby helping to hold it in place.

The choice of material is another feature of the invention. Plastic, with its inherent resiliency, is not only an inexpensive material, but also provides good gripping action when formed to "pinch" the blade and can be easily manufactured to conform to the curve of a hockey stick blade.

Making the weight full length and uniform are other features of the present invention, because this configuration distributes the weight over the blade rather than concentrating it on the handle base or somewhere along the blade. The torque of the distributed weight is the same as that when a load is placed only at the "sweet spot" of the stick, but the distributes weight provides more surface area for gripping the blade than a concentrated weight.

Other features and advantages of the present invention will be apparent to those skilled in the art from a careful reading of the Detailed Description of A Preferred Embodiment accompanied by the following drawings.

DETAILED DESCRIPTION OF A PREFERRED EMBODIMENT

Figure 1:
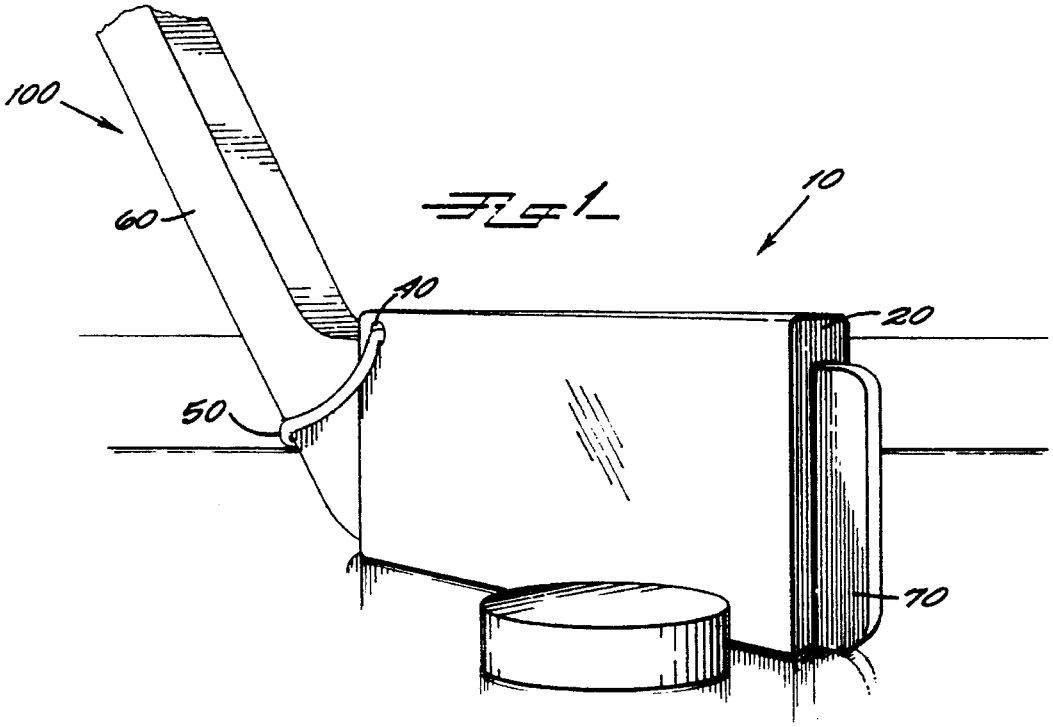
FIG. 1 is a perspective view of a weight according to a preferred embodiment of the present invention.
Figure 2:
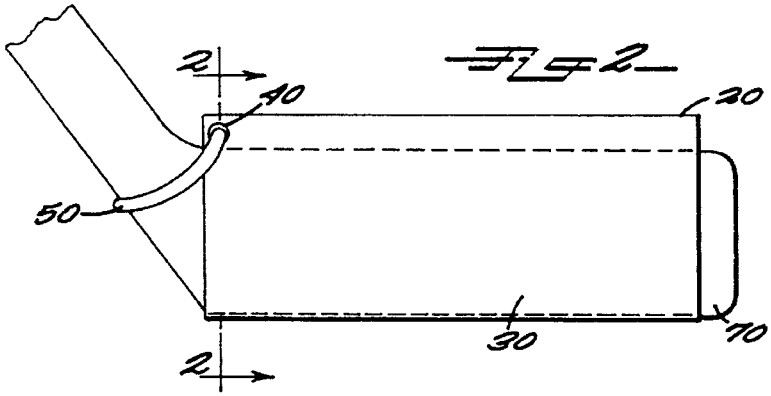
FIG. 2 is a side view of the weight of FIG. 1, with the hockey stick in phantom.
Figure 3:
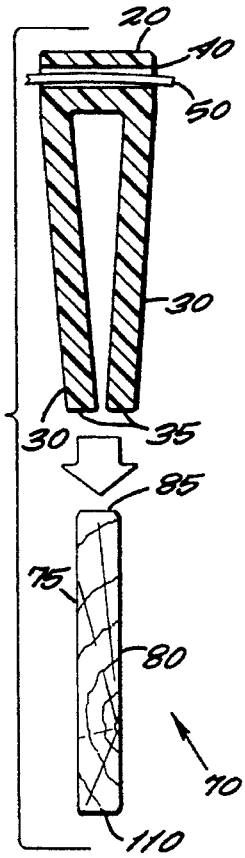
FIG. 3 is a cross sectional front view of the weight of FIG. 1 and an end view of the blade of a hockey stick.

Referring now to FIGS. 1, 2, and 3, a training weight 10 in its preferred embodiment comprises a bridge member 20, plates 30, a hole 40 and a tether 50. Plates 30 are integrally joined to, and depend from bridge member 20. As best seen in FIG. 3, plates 30 depend from bridge member 20, at acute angles with respect to the plane of bridge member 20, and therefore plates 30 converge with respect to each other.

In the preferred embodiment, bridge member 20 and plates 30 are made of a durable, flexible, resilient, impact-resistant plastic. Alternatively, bridge 20 and plates 30 can be made of a plastic-coated metal. Tether 50 must be of a sufficient strength and length to secure it to a shaft 60 of a hockey stick 100. Materials suitable for tether 50 include leather thongs, plastic or metal wires, or cotton or nylon cord.

As best seen in FIGS. 1 and 2, the length of training weight 10 is approximately equal to the length of a blade 70 of hockey stick 100. The length of training weight 10 ensures a uniform load application across the length of blade 70 and avoids the problems associated with uneven load applications, but provides ample area of engagement between plates 30 and blade 70 for good frictional holding.

Figure 5:
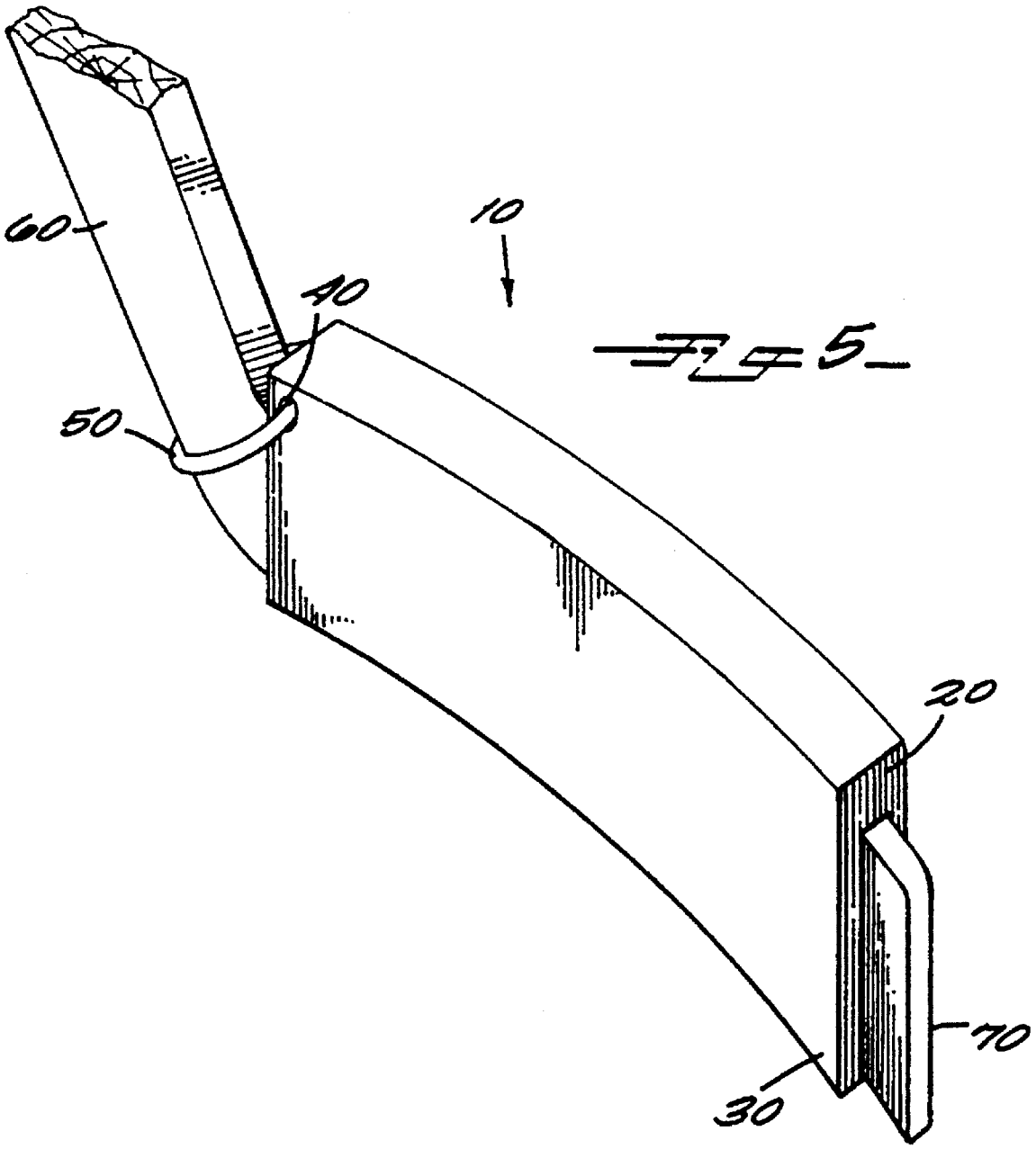
FIG. 5 is a perspective view of a weight according to an alternative preferred embodiment of the present invention.

Training weight 10 can be manufactured to any desired weight, however, in the preferred embodiment, weight 10 weighs approximately four ounces, eight ounces or one pound, corresponding to the weights of one, two or three regulation pucks, respectively. As shown in FIG. 5, training weight 10 can be manufactured to contour a curved blade for either a left or right handed player by curving bridge 20 and plates 30 to conform to blade 70.

Figure 4:
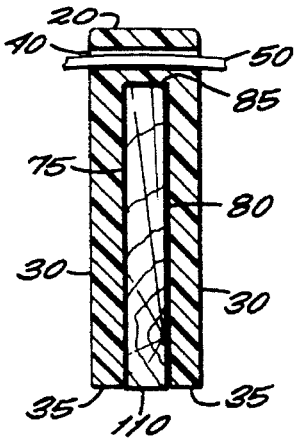
FIG. 4 is a cross sectional front view of the weight of FIG. 1 taken along line 2—2 of FIG. 2, in use.

Referring now to FIG. 3, training weight 10 is shown prior to placement on blade 70. As can be seen, plates 30 of training weight 10 converge, such that the distance between plates 30 at ends 35 is less than the width of a top portion 85 of blade 70. Therefore, to place training weight 10 on blade 70, a user must apply a force sufficient to spread plates 30 apart until top portion 85 fits between plates 30. Thereafter, moderate pressure is applied to bridge member 20 forcing plates 30 toward a surface engaging portion 110 of blade 70. This pressure is continued until bridge member 20 abuts top portion 85 of blade 70 and ends 35 of plates 30 are flush with surface engaging portion 110 of blade 70. As best seen in FIG. 4, when training weight 10 is placed on blade 70, plates 30 will depend from bridge 20 at substantially right angles parallel to and in engagement with first and second faces 75, 80, of blade 70. When in place, plates 30 will straddle blade 70 and frictionally engage first face 75 and second face 80 of blade 70 as a result of wedging or pinching blade 70 between plates 30, thereby ensuring a secure fit. Thereafter, tether 50 is threaded through hole 40 and tied or secured to shaft 60 of hockey stick 100. Tether 50 holds training weight 10 in place and prevents it from jarring loose or sliding off the end of blade 70.

It will be apparent to those skilled in the art that many modifications and substitutions can be made to the foregoing preferred embodiment without departing from the spirit and scope of the present invention, which is defined by the appended claims.

What is claimed is:

1. A weight training device for use with a hockey stick, said stick having a shaft and a blade attached to said shaft, said blade having a length, a first face and an opposing second face, said device comprising a weight formed to be adapted to straddle said blade, said weight having a length approximately equal to said length of said blade, wherein said weight is adapted to be removably attachable to said blade.

2. The device as recited in claim 1, wherein said weight is adapted to frictionally engage said first and said second face of said blade.

3. The device as recited in claim 1, wherein said weight further comprises:

two spaced apart plates; and a bridge member joining said plates, said plates adapted to engage said first and second faces of said blade.

4. The device as recited in claim 1, further comprising means for adaptively securing said weight to said hockey stick.

5. The device as recited in claim 1, wherein said weight has a hole formed therein and said device further comprises a tether, said tether threadable through said hole in said weight.

6. The device as recited in claim 1, further comprising a tether to adaptively tie said weight to said hockey stick, said tether made of a material selected from the group consisting of leather thongs, plastic wires, metal wires, cotton cord and nylon cord.

7. The device as recited in claim 1, wherein said blade is curved and wherein said weight is curved to conform to said blade.

8. The device as recited in claim 1, wherein said weight is made of a material selected from the group consisting of plastic, metal, and plastic coated metal.

9. The device as recited in claim 1, wherein said weight weighs between approximately four ounces and approximately one pound.

10. A weight training device for use with a hockey stick, said hockey stick having a shaft and a blade attached to said shaft, said blade having a length, a first face and a second face opposite said first face, said blade having a top and a bottom, said device comprising:

two spaced apart, converging plates; and a bridge member joining said plates, said bridge member having a width said bridge member having a length approximately equal to said length of said blade, said two plates depending from said bridge member, so that when said device is adapted to be attached to said blade, said device covers said first and second face and said top of said blade, but does not cover said bottom of said blade.

11. The device as recited in claim 10, further comprising means for adaptively securing said device to said shaft of said hockey stick, said securing means comprising a tether for adaptively tying said device to said shaft of said hockey stick.

12. The device as recited in claim 10, wherein said two plates converge sufficiently so that, when said device is adapted to be placed on said blade of said hockey stick, said plates frictionally engage said first face and said second face of said blade.

13. The device as recited in claim 10, wherein said device is made of a material selected from the group consisting of plastic, metal, and plastic coated metal.

14. The device as recited in claim 10, wherein said device weighs between approximately four ounces and approximately one pound.

15. A weight training device for use with a hockey stick, said hockey stick having a shaft and a blade attached to said shaft, said blade having a length, a first face and a second face opposite said first face, said device comprising:

two spaced apart plates;

a bridge member joining said plates, said bridge member having a width, said bridge member having a length approximately equal to said length of said blade, said two plates depending from said bridge member, said two plates defining a distance therebetween; and means for adaptively securing said bridge member to said shaft of said hockey stick.

16. The device as recited in claim 15, wherein said bridge member has a hole formed therein and said securing means further comprises a tether threaded through said hole, said tether chosen from the group consisting of leather thongs, plastic wires; metal wires, cotton cord and nylon cord.

17. The device as recited in claim 15, wherein said two plates converge so that, when said device is adapted to be placed on said blade of said hockey stick, said plates frictionally engage said first face and said second face of said blade, and wherein said device weighs between approximately four ounces and approximately one pound.

* * * * *